United States Patent [19]

Hoekman

[11] Patent Number: 4,697,170

[45] Date of Patent: Sep. 29, 1987

[54] METHOD FOR MINIMIZING FALSE ALARMS AND ELECTRONIC NOISE IN ELECTRONIC ARTICLE SURVEILLANCE SYSTEMS.

[75] Inventor: Earl B. Hoekman, Roseville, Minn.

[73] Assignee: Minnesota Mining and Manufacturing Company, St. Paul, Minn.

[21] Appl. No.: 793,203

[22] Filed: Oct. 31, 1985

[51] Int. Cl.[4] ..... G08B 13/24

[52] U.S. Cl. ..... 340/551; 307/100; 340/501; 340/572; 439/514

[58] Field of Search ..... 340/572, 551, 501, 407; 339/9, 222; 307/100

[56] References Cited

U.S. PATENT DOCUMENTS

| | | | |
|---|---|---|---|
| 1,137,489 | 4/1915 | Jellinek | 174/72 C |
| 3,270,124 | 8/1966 | Rawls et al. | 174/141 R |
| 3,665,449 | 5/1972 | Elder et al. | 340/572 |
| 4,135,183 | 1/1979 | Heltemes | 340/572 |

FOREIGN PATENT DOCUMENTS

| | | | |
|---|---|---|---|
| 763681 | 2/1934 | France | 2/12 |

*Primary Examiner*—Glen R. Swann, III

*Attorney, Agent, or Firm*—Donald M. Sell; James A. Smith; William B. Barte

[57] ABSTRACT

A method for minimizing false alarms and background electronic noise in an electronic article surveillance system operated in the vicinity of substantially closed electrical loops such as formed by metal door and window frames. If the conductance of such loops is variable, electric currents induced in such loops by electromagnetic fields produced by the system have been found to be discontinuous, and can both produce a false alarm and raise the background noise level. The method comprises connecting metal straps across all joints in such loops to ensure permanent, reliable electrical connections at all such joints, thus providing greatly reduced variations in conductance around the loop.

4 Claims, 7 Drawing Figures

METHOD FOR MINIMIZING FALSE ALARMS AND ELECTRONIC NOISE IN ELECTRONIC ARTICLE SURVEILLANCE SYSTEMS.

BACKGROUND OF THE INVENTION

1. Field of the Invention

This invention relates to electronic article surveillance (EAS) systems for detecting the unauthorized removal of objects from a protected area, and in particular, to such systems in which an alternating magnetic field is produced in an interrogation zone thereby enabling the detection of a ferromagnetic marker.

2. Description of the Prior Art

EAS systems based on the detection of a ferromagnetic marker are now well known, having been disclosed at least as early as 1934 in French patent No. 763,681 (Picard) and more recently disclosed in patents as U.S. Pat. Nos. 3,665,449, 4,135,183 and the like. In all such systems, an interrogation antenna usually comprising at least one coil several feet wide, is positioned within a pedestal on one side of an exit way and is energized to generate a magnetic field alternating at a predetermined frequency. The field encompasses a zone within which an object carried by a person passing through the zone would encounter the produced field. In such a system, a detector coil is typically positioned within the same pedestal or may be located within a second pedestal spaced from the first pedestal to define the interrogation zone therebetween, and the detector coil is connected to a signal detector and alarm indicator circuit. When an object, the unauthorized removal of which is to be prevented, is provided with a ferromagnetic marker, the interaction of the alternating field with the marker creates harmonics of the predetermined frequency, and those harmonics are picked up by the detector coil and processed to indicate the presence of a marker. The magnetic fields produced within the interrogation zone may also induce currents in other conductive and/or magnetic objects which may be proximate to the interrogation zone. Such induced currents and/or magnetically produced responses may result in the production of false alarms and/or artificially high electromagnetic background signals.

SUMMARY OF THE INVENTION

The method of the present invention overcomes at least one source of potential false alarms and/or artificially high background noise observed to be present in certain installations of EAS systems such as described hereinabove. As a result of extensive experience with such systems, it has now been recognized that an abnormally high incidence of false alarms and/or high electromagnetic background noise occurs in installations where large metal objects such as window and door frames and the like form electrically conducting, closed loops near the interrogation zone. In conformance with Faraday's law, the changing magnetic fields generated by the EAS systems cause currents to flow in such conductive loops. Those currents in turn generate a changing magnetic field which may be sensed by the receiving antenna of the system. If the loop is stable, i.e., such as with a completely welded frame so that the conductance in the loop does not change, the fields generated by currents induced in the loops will contain only the frequency of the alternating magnetic field produced by the interrogation coil, and signals produced by the field generated by those loops can be filtered out with conventional filtering methods.

However, it has now been found that if the conductance of such loops is variable, higher harmonics may be generated by the induced currents and in some cases rapid changes in the conductance have been found to generate signals having frequency components similar to those generated by ferromagnetic markers, thereby resulting in false alarms. Furthermore, it has been found that variable conductance in such loops may create sufficient electronic noise to lower the signal to noise ratio below the point at which the signals from ferromagnetic markers can be reliably distinguished. It has been found that sufficient currents may be induced in such loops to actually sustain an arc at joints in door or window frames, particularly as such frames are not designed to have reliable high conductivity joints. Furthermore, frame movement from contraction and expansion due to temperature changes, and due to the opening or closing doors and windows has been found to vary the conductance across such joints. Similarly, joint wear and corrosion have been found to aggravate the problem of incomplete joints. The closer such loops are to the interrogation zone, the more aggravated the problem becomes.

The method of the present invention minimizes such false alarms and high noise environments by electrically connecting across all sections of each such substantially closed loop at which the effective resistance may be variable, at least one section of conductive material having a predetermined length and cross section, thereby completing across all of such sections a highly stable, parallel electrical path having a low and constant effective resistance. Such a parallel path prevents large rapid changes in the alternating currents induced in such loops, with the result that the generation of currents alternating at frequencies which are high orders of the alternating field are prevented. This avoids confusion with marker produced harmonic signals. Similarly, the prevention of large rapid changes avoids the creation of artificially high background electrical noise which may also mask the detection of marker produced signals.

DESCRIPTION OF THE PREFERRED EMBODIMENTS

Figure 1:
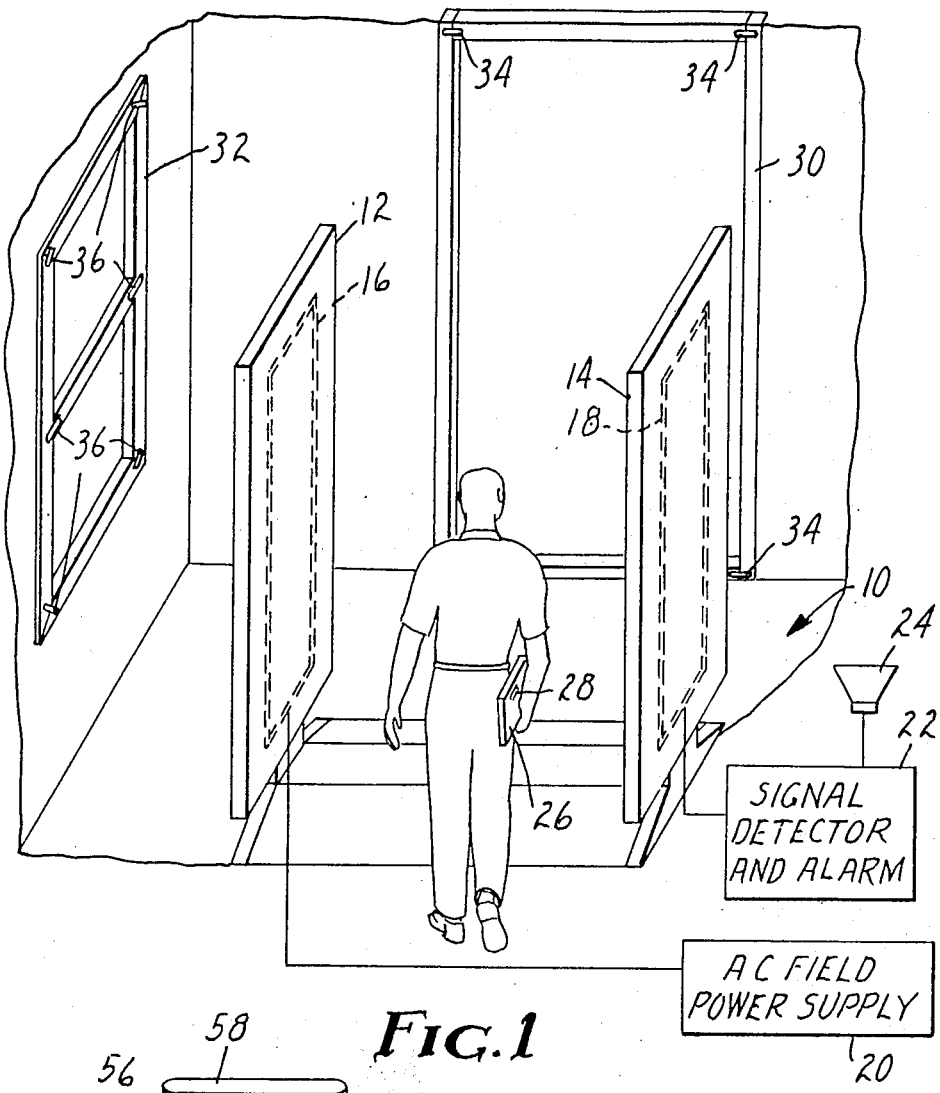
FIG. 1 is a combined perspective view and block diagram of one embodiment of the present invention.

FIG. 1 is a combined perspective and block diagram of an antipilferage system 10 such as may be conveniently used at the exit of an area in which objects to be protected are kept. In this figure, pedestals 12 and 14 are shown positioned to define a corridor therebetween within which is an interrogation zone. Positioned within each of the pedestals 12 and 14 is at least one field producing coil 16 and at least one detector coil 18. As described in the aforementioned patents, the field producing coil 16 will be typically energized by a source of alternating electrical currents such as the AC field power supply 20 and signals induced into the detector coil 18 will be processed within a signal detector and alarm circuit 22 to provide a suitable alarm by a speaker or similar device 24. Accordingly, an object, such as a book 26, is provided with a marker 28, such as an elongated strip of high permeability ferromagnetic material. When the object and marker secured thereto are carried into the interrogation zone between the opposing panels 12 and 14, the alternating field produced by the field producing coil 16 will cause the magnetization within the strip 28 to be reversed, with the result that signals containing high order harmonics of the alternating field will be produced and those high order harmonic signals detected by the receiver coil 18, so as to ultimately produce an alarm.

As noted above, such systems are frequently positioned near an exit such as a doorway 30, and in many instances will likewise be positioned near a window 32. It has been found that if the frames of doorways or windows are constructed of metal, such as extruded aluminum members, welded steel sections or the like, the magnetic field produced by the field producing coil 16 may cause significant current to flow in those frames, or like closed electrical loops present in the vicinity of the field producing coil 16. As long as such frames constitute an incomplete loop, such that no circulating oscillating currents can be induced therein, or are very good, i.e. highly and uniformly conductive closed loops, such as typically only occurs with a completely welded enclosure, no interference or adverse effect upon the operation of an adjacent EAS system results. In the former situation, no currents are induced in the open frame and hence no field associated with it occurs. In the latter case, while oscillating currents will be induced in the highly conductive closed loop, the fact that the loop has a constant conductance, results in the creation of a field having only the same frequency components as produced by the field producing coil. Accordingly, no signals are generated which can either be confused with the signals produced by a marker 28, or which would result in an abnormally high electromagnetic background noise.

According to the present invention, it has now been found that such adverse effects on the operation of an adjacent EAS system may be prevented by providing a highly conductive and highly stable parallel electrical path having a low and constant effective resistance across all suspect electrical connections around such a substantially closed loop. Thus, for example, highly conductive metal straps 34 are provided across all corners of the frame 30 where the respective vertical and horizontal members are joined. Similarly, metal straps 36 are shown to be added across the corners and horizontal joints within the window frame 32. Such straps have been found to be a more practical remedy to the a problem presented by such incomplete joints than is repair of the joints themselves. It has been found that the strap can be screwed in place and yet provide a long life, high conductance path. Furthermore, the installation of the straps can be standardized and thus enable installation by field service personnel without requiring expensive alteration of existing architectural structures.

The best mode of providing such a parallel electrical path has been found to utilize a wrought copper, tin plated strap having a slightly raised, or off-set center portion, thus forming a shallow, substanially U-shaped configuration, which is fastened on each side of the joint using No. 10-24 self tapping, tin plated screws having integrally attached domed lock washers (SEMS screws) to maintain pressure. Preferably the frame members are predrilled and the screw threads and holes coated with a locking compound such as "Lock-Tight #290" before fastening the strap in place. The compound thereby seals out air and prevents the screws from subsequently loosening. When located in very corrosive environments, the joint may also be preferably overcoated with a corrosion protecting coating such as 3M Type 1610.

Figure 2:
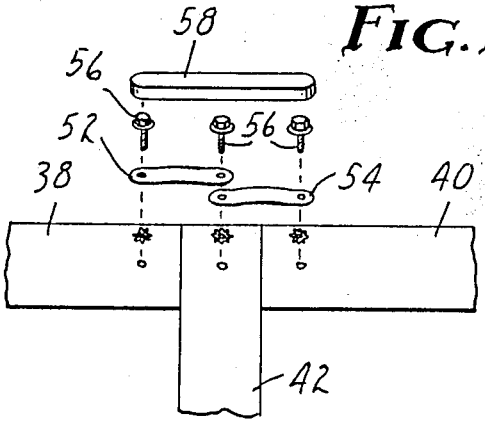
FIGS. 2 and 3 are side views of embodiments wherein highly stable, low resistance paths are provided across joints of metal window and door frames according to the teachings of the present invention.
Figure 3:
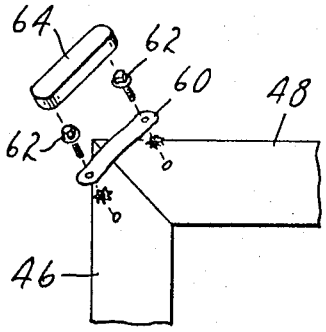

Two typical joint constructions are shown in plane view in FIGS. 2 and 3. In FIG. 2, a T-joint such as may be present along the edge of a double window frame is shown to include the extruded frame members 38, 40 and 42, respectively, which may be joined together by a variety of techniques such as internal supports, bolts, rivets or the like. It will be recognized that while such a joint may be structurally sound, it is not designed for electrical contact, and may result in an imperfect conductance across the joint.

In order to render such a frame joint reliably electrically conductive, the method of the present invention is shown in FIG. 2 to have secured across the respective joined members 38, 40 and 42 connecting straps 52 and 54. The center portion of each of the straps is slightly raised, or off-set into a shallow, substantially U-shaped configuration to prevent the transmission of mechanical stresses at the joined members to the electrical contact points formed by the SEMS screws 56. Also shown in FIG. 2 is a cover assembly 58, which may be provided to cover the connecting straps for aesthetic purposes and also to provide mechanical protection. Similarly, the cover assemblies may be filled with silicone resin to provide further protection against corrosion at the screw heads.

In FIG. 3, an alternate method for ensuring reliable contact across a mitered joint may be seen to include the use of a single strap 60 secured by SEMS screws 62 across the mitered members 46 and 48. The strap 60 may be covered with a suitable cover member 64 for improved environmental protection and the recesses within the cover member filled with suitable sealant such as a silicone resin.

The highly conductive straps having off-set, shallow U-shaped center portions such as formed of tin-plated copper have been found to be particularly desirable for use in the method of the present invention. Upon first impression it may be expected that relative massive frame members such as formed of extruded aluminum channels or welded steel would have a very high conductance and that a well made joint including a connecting member providing splicing members, screwed or otherwise fixed in place would have a similarly high conductance. However, in applications encountered with typical article surveillance systems, the electromagnetic fields produced by the interrogation coils are relatively high frequency, generally in the range of 1 to 10 kilohertz, and at those frequencies the skin depths, i.e., the depth of penetration of electrical currents into the conductors becomes relatively short such that the entire volume of the frame does not carry significant amounts of current. The overall effective frame conductance is therefore significantly lower, i.e., the effective resistance is higher, than might be anticipated. Indeed, in many instances where the frames have substantial depth, it has been found desirable to place conductive straps on both sides of the frame. Also, the importance of obtaining both a highly conductive and a highly stable conductive path across the joint cannot be over emphasized. For example, it has been found that a strap formed of woven copper wires is not as effective as the use of a solid wrought copper strap, as the conductivity of the copper braid has been found to change slightly as it is flexed, and such changes result in electrical interference.

The advantage afforded by the present invention in both reducing false alarms and in maintaining a relatively high signal to noise ratio environment is readily apparent in the oscillograms reproduced in FIGS. 4–7. These data were obtained from a prototype electronic article surveillance system, identified as a 3M Model WH-11000 system produced by Minnesota Mining and Manufacturing Company having advanced signal processing circuitry. In such, and analogous systems, the output signal from the detector coil corresponds to that shown in FIG. 4, and appears to be essentially a sine wave, having the same frequency (ca. 9.6 KHz) as produced by the interrogation antenna. That fundamental frequency is then filtered out by appropriate filtering techniques in order to enable the much lower amplitude higher frequency harmonic signals to be processed without the much more intense fundamental frequency signal saturating the detector circuitry.

Figure 4:
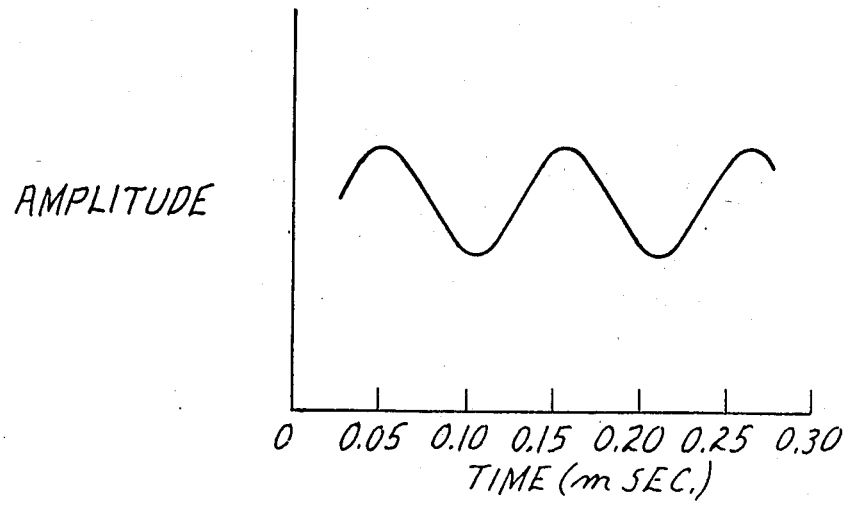
FIGS. 4–7 are oscillograms showing the effect of the present invention on detected signals.
Figure 5:
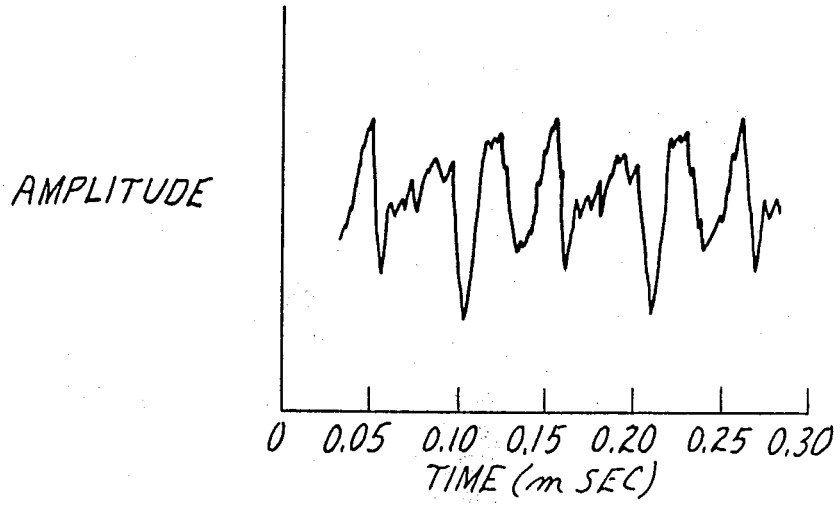

FIG. 5 depicts the background noise, on a much amplified scale than that of FIG. 4, present after such filtering has been performed, when a simulated closed conductive loop having a poor joint was positioned next to interrogation antenna. The simulated loop comprised a one-inch square aluminum tube bolted together to form a rectangular loop, 6 feet by 7 feet in area, with particular care being used to ensure good conductance across three of the four joints. The members forming the fourth joint were insulated from each other, and a pointed screw extending from a support securely fastened to and in good electrical contact with one of the members was advanced so that the point of the screw was spaced less than a micrometer from the surface of the other member. Such a configuration was found to repeatedly reproduce the noise signal typically, but unreproducibly, encountered in field installation when poor joints in conductive windows or door frames are present, as the alternating field produced by the interrogating antenna would cause minute electrical arcs to occur between the spaced members thereby resulting in the same electrical interference in the detector circuitry.

Figure 6:
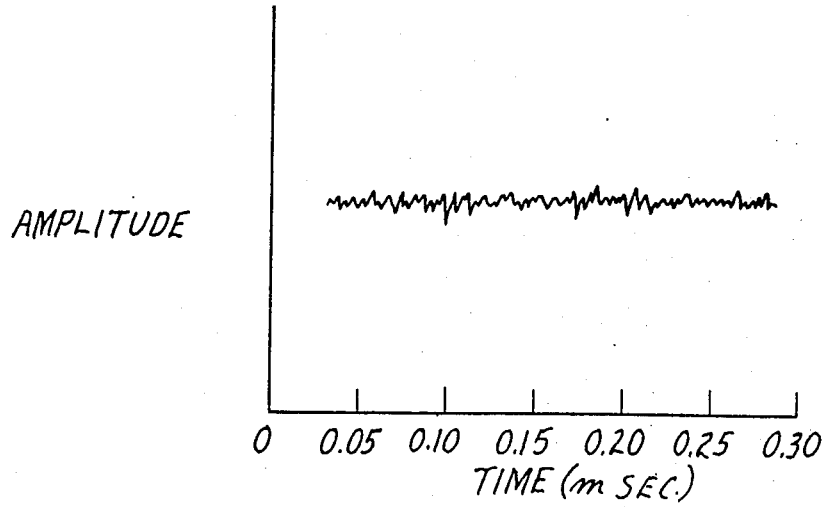

Upon affixing a conductive strap as described above across the insulated joint, the background noise level, shown on the same scale as that shown in FIG. 5, was reduced to that shown in FIG. 6. The same background noise level is typically present when no such loop is present near the system or when such a loop is welded or otherwise made to exhibit stable conductance.

Figure 7:
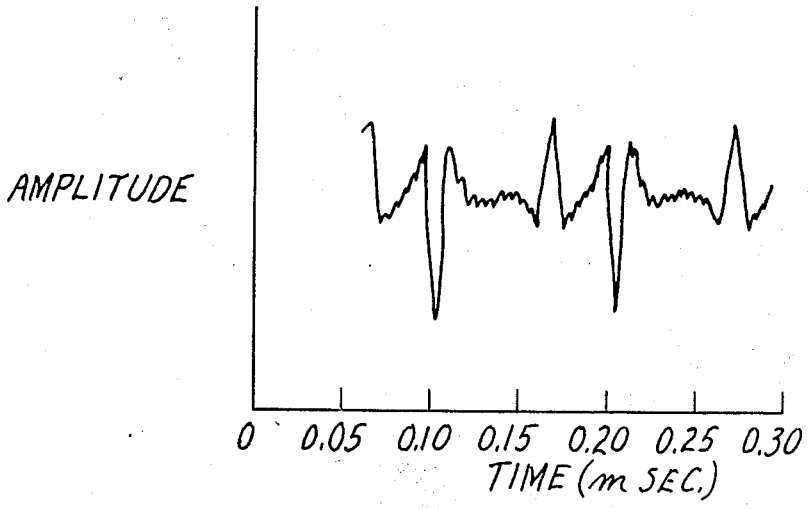

When a ferromagnetic marker was then introduced into the interrogation zone, the signal after filtering was as shown in FIG. 7, which figure is also shown on the same scale as that of FIGS. 5 and 6. The sharp spikes there shown are known, and can be shown by appropriate spectrum analysis techniques, to contain the high frequency harmonically related signal components upon which such markers can be reliably distinguished from other articles. It will thus be readily apparent that the similar appearing spikes present in the signal occurring with a simulated poor joint, as shown in FIG. 5, will often result in the production of false alarms. Also, the much larger background noise represented by the large peak-to peak amplitude of that signal will obviously make the detection of the marker produced signals of comparable amplitude much more difficult.

I claim:

1. A method of minimizing false alarms and high noise environments potentially present in electromagnetic article surveillance systems in which a magnetic field alternating at a predetermined frequency is created in an interrogation zone and signals corresponding to harmonics of the predetermined frequency are detected, wherein in the vicinity of the interrogation zone are present metallic structures forming at least one substantially closed loop, such as created by a metallic door frame or the like, said method comprising the step of electrically connecting across each joint of each such substantially closed loop at which the effective resistance may be variable, at least one section of conductive material to provide across all said joints a highly conductive, highly stable parallel electrical path having a low and constant effective resistance, thereby preventing large rapid changes in the alternating currents induced in said loop by said alternating field, with the result that the generation of currents alternating at frequencies which are high order harmonics of the alternating field are also prevented and confusion with marker produced harmonic signals is avoided, while also avoiding artifically high background electrical noise which tends to mask the detection of said marker produced signals.

2. A method according to claim 1, comprising providing straps of highly conductive metal and permanently affixing said straps to portions of said metallic structures on each side of a joint at which a variable effective resistance may be present.

3. A system for minimizing false alarms and high noise environments potentially present in electromagnetic article surveillance systems in which a magnetic field alternating at a predetermined frequency is created in an interrogation zone and signals corresponding to harmonics of the predetermined frequency are detected, wherein in the vicinity of the interrogation zone are present metallic structures forming at least one substantially closed loop, such as created by a metallic door frame of the like, said system comprising a plurality of pieces of conductive material, and means for securely fastening across each joint of each such substantially closed loop at which the effective resistance may be variable, at least one of said pieces, so as to provide across each said joint a highly conductive, highly stable parallel electrical path having a low and constant effective resistance, thereby preventing large rapid changes in the alternating currents induced in said loop by said alternating field, with the result that the generation of currents alternating at frequencies which are high order harmonics of the alternating field are also prevented and confusion with marker produced harmonic signals is avoided, while also avoiding artifically high background electrical noise which tends to mask the detection of said marker produced signals.

4. A system according to claim 3, wherein said attachment means comprises self-tapping screws, locking means for preventing loosening due to thermal and vibrational forces, and sealant means for further preventing loosening and corrosion.

* * * * *